United States Patent [19]

Hirschberg et al.

[11] 4,363,720

[45] Dec. 14, 1982

[54] PASSIVATING METALS ON CRACKING CATALYSTS WITH ZINC

[75] Inventors: Eugene H. Hirschberg, Park Forest; Ralph J. Bertolacini, Naperville; Frank S. Modica, Downers Grove, all of Ill.

[73] Assignee: Standard Oil Company (Indiana), Chicago, Ill.

[21] Appl. No.: 263,297

[22] Filed: May 13, 1981

[51] Int. Cl.[3] ..... C10G 11/02; C10G 11/18

[52] U.S. Cl. ..... 208/120; 208/52 CT; 208/121; 252/411 R; 252/417; 252/422; 252/457; 423/244

[58] Field of Search ..... 208/52 CT, 120, 121; 252/411 R, 457

[56] References Cited

U.S. PATENT DOCUMENTS

| | | | |
|---|---|---|---|
| 2,436,927 | 3/1948 | Kassel | 252/417 |
| 2,901,419 | 8/1959 | Brill | 208/119 |
| 3,364,136 | 1/1968 | Chen et al. | 208/120 |
| 4,146,463 | 3/1979 | Radford et al. | 208/120 |
| 4,153,534 | 5/1979 | Vasalos | 208/120 |
| 4,153,535 | 5/1979 | Vasalos et al. | 208/120 |
| 4,198,287 | 4/1980 | Hemler | 208/113 |
| 4,280,898 | 7/1981 | Tatterson et al. | 208/119 |

*Primary Examiner*—Delbert E. Gantz
*Assistant Examiner*—G. E. Schmitkons
*Attorney, Agent, or Firm*—William H. Magidson; William T. McClain

[57] ABSTRACT

A hydrocarbon cracking catalyst is treated with zinc to passivate contaminant metals, e.g., nickel, copper, vanadium, and iron, which are deposited on the catalyst during the catalytic cracking of hydrocarbon feedstocks.

9 Claims, No Drawings

PASSIVATING METALS ON CRACKING CATALYSTS WITH ZINC

FIELD OF THE INVENTION

This invention relates to the catalytic cracking of hydrocarbon feedstocks. More particularly, it relates to a process for passivating contaminant metals which deposit on the cracking catalyst by the addition of a zinc-containing treating agent.

BACKGROUND OF THE INVENTION

1. Contaminant Metals in Catalytic Cracking

Hydrocarbon feedstocks containing higher molecular weight hydrocarbons can be converted into lighter weight products, such as gasoline, by the process of catalytic cracking. This process is adversely affected if certain metals, such as platinum, palladium, chromium, nickel, copper, vanadium, and iron are present. These metals are themselves hydrogenation-dehydrogenation catalysts and cause the increased formation of coke and hydrogen gas, thereby decreasing the yield of the desired gasoline. In addition, these metals affect both the activity and selectivity of the cracking catalyst.

Unfortunately, nickel, copper, vanadium, and iron are often present as contaminants in the hydrocarbon feedstocks which are catalytically cracked. For example, the metals level in the gas oils which traditionally have been the catalytic cracking feedstock is generally about 0.25 ppm Nickel Equivalent. The term "ppm Nickel Equivalent" is defined here as ppm Nickel Equivalent = ppm nickel + ppm copper + (0.2)(ppm vanadium) + (0.1)(ppm iron)

Since the individual metals levels are weighted, this term takes into account that, if present at equal levels, the adverse effects of nickel and copper are substantially greater than those of vanadium, whose effects are, in turn, greater than those of iron.

Traditionally, the problem of contaminant metal deposition has not been serious because it is common practice to continually withdraw a portion of the catalyst in the unit, discard it, and replace it with fresh catalyst. While this withdrawal is primarily done to maintain catalyst activity (which decreases with time), it also has the effect of controlling the metals level on the catalyst at a level where the adverse effects are minimal.

As an example, assume that: (1) a catalytic cracking unit processes 50,000 bbls/day of gas oil, (2) the gas oil density is 390 lbs/bbl, (3) the gas oil has a metals content of 0.25 ppm Nickel Equivalent, (4) the fresh catalyst has a metals level of 25 ppm Nickel Equivalent, and (5) the catalyst inventory in the unit is 300 tons. Then, if the catalyst withdrawal rate is 1.5 percent, or 4.5 tons/day, the average metals level on the catalyst in the unit is about 600 ppm Nickel Equivalent, a level at which the adverse effects are minimal.

Recently, the problem of contaminant metal deposition has become more serious because the metals level in catalytic cracking feedstocks is rising. There are two major reasons for this rise. First of all, refiners have begun using more of the lower quality crude oils which contain higher levels of contaminant metals. And when the metals level in the crude is higher, the metals level in the gas oil fraction is also higher. Secondly, and more importantly, there now exists a great economic incentive to catalytically crack residual oils rather than to sell them for use as fuels. It is in the residual oil fraction that the contaminant metals in the crude are most concentrated.

As a result of these recent changes, the contaminant metals level in catalytic cracking feedstocks often greatly exceeds the traditional level of 0.25 ppm Nickel Equivalent. For example, gas oil fractions from lower quality crudes can exceed 1.0 ppm Nickel Equivalent and when blends of gas oil and residual oil are used, the metals level can reach 40.0 ppm Nickel Equivalent.

At these higher metals levels, catalyst withdrawal alone is no longer adequate to control the adverse effects of contaminant metal deposition. For instance, in the above example of a 50,000 bbl/day unit, an increase in the metals level of the feedstock from 0.25 to 1.0 ppm Nickel Equivalent has a tremendous effect. If the metals level on the catalyst is to be maintained at 600 ppm Nickel Equivalent, the withdrawal-replacement rate must increase fourfold to 18 tons/day. The cost of the catalyst itself and of materials handling prohibit significantly increasing the rate beyond the rate necessary to maintain catalyst activity. On the other hand, if the catalyst withdrawal-replacement rate is maintained at 4.5 tons/day, the metals level on the catalyst in the unit jumps to about 2400 ppm Nickel Equivalent, a level at which the adverse effects are intolerable.

Several approaches have been developed to supplement catalyst withdrawal-replacement when the metals level in the feedstock rises to about 1.0 ppm Nickel Equivalent. One approach is to use a separate metals-removing step before the hydrocarbon feedstock is catalytically cracked. This approach suffers from the disadvantages of being very costly to operate and of requiring a large amount of new equipment to implement. A second approach is to remove the metals from the cracking catalyst after they have been deposited and then reuse the catalyst. This approach is also costly to operate and requires new equipment.

A third approach, passivation, is to chemically treat the catalyst so as to reduce the tendency of deposited metals to catalyze the formation of coke and hydrogen gas. This approach has heretofore presented difficulties because many chemicals which are effective passivating agents are also highly toxic and/or very expensive. Examples of known passivating agents include the compounds of antimony, bismuth, tellurium, and thallium. However, to our knowledge, no one has suggested that zinc and its compounds, which are nontoxic and relatively inexpensive, are effective passivating agents. Although zinc has not been taught as a passivating agent, its use has been mentioned for other purposes.

One example is the teaching in "Catalysis" edited by P. H. Emmett (Reinhold Publishing Corp. 1954) at page 31 that a nickel hydrogenation-dehydrogenation catalyst can be poisoned by compounds of sulfur, selenium, tellurium, phosphorus, arsenic, antimony, bismuth, and zinc, and also by halides, carbon monoxide, mercury, lead, ammonia, pyridine, 1-ethyl-cyclopentane, oxygen, acetylene, hydrogen sulfide, phosphine, iron oxide, and silver dust.

Zinc has also been mentioned for uses in connection with the catalytic cracking of hydrocarbons. As discussed in detail below, zinc has been mentioned both as an oxidation catalyst and as a sulfur dioxide absorbent. In other words, zinc has been taught to have utility when present in the regeneration zone of a catalytic cracking process, but not when present in the reaction zone.

2. Zinc as an Oxidation Catalyst

Kassel, U.S. Pat. No. 2,436,927, discloses a catalytic cracking process in which afterburning is controlled by combining a carbon monoxide oxidation catalyst with a conventional cracking catalyst. Suitable oxidation catalysts are the oxides of the metals from the First Transition Series of the Periodic Table comprising chromium, manganese, cobalt, nickel, and copper. Zinc the next element in this series, was not mentioned.

In Kassel, the oxidation catalysts are effective when they comprise "a very small proportion of the total catalyst used in the cracking process." As an example, cobalt is effective when present in an amount from about 5 to about 100 ppm, calculated as the metal and based on the total weight of the solid particles. The examples use only cobalt as the oxidation catalyst. The specification does not mention the level of contaminant metals in the hydrocarbon feedstocks.

Chen, U.S. Pat. No. 3,364,136, discloses a catalytic cracking process which involves the use of a cracking catalyst in combination with a second component which will catalyze the oxidation of carbon monoxide to carbon dioxide while remaining catalytically inert with respect to the cracking reaction. This second component is a shape selective aluminosilicate containing an oxidation catalyst in its internal pore structure and having a pore size such that it will admit carbon dioxide, oxygen and carbon monoxide and exclude organic compounds. Suitable oxidation catalysts are metals of Groups I-B, II-B, VI-B, VII-B, and VIII of the Periodic Table as well as compounds thereof such as oxides and sulfides. It is noted that representative metals would include chromium, nickel, iron, molybdenum, cobalt, platinum, palladium, copper, zinc, etc.

In Chen, the oxidation catalyst can be present in an amount from 0.01 to 20 weight percent of the small-pore aluminosilicate. The weight ratio of the small-pore aluminosilicate to the conventional cracking catalyst can range from 1:1000 to 1:1, and preferably from 1:100 to 1:5. The examples use only platinum as the oxidation catalyst. The specification does not mention the level of contaminant metals in the hydrocarbon feedstocks.

A third reference which teaches the use of an oxidation catalyst to reduce carbon monoxide emissions is Hemler, British Pat. No. 1,567,261. Hemler teaches that the oxidation catalyst be added to the regeneration zone independently of the cracking catalyst. Suitable oxidation catalysts, or "promoters," include metals of Groups I-B, II-B, VI-B, VII-B, and VIII of the Periodic Table as well as the compounds thereof. Representative metals include chromium, nickel, iron, molybdenum, cobalt, copper, zinc, manganese, and vanadium. The preferred metals are the "noble metals," i.e., gold, silver, mercury, platinum, palladium, iridium, rhodium, ruthenium, and osmium.

In Hemler, the oxidation catalyst is usually present in an amount from 0.1 to 25 ppm, based on the total weight of the solid particles. The preferred range is from 0.1 to 15 ppm. The examples use only platinum. The specification does not mention the level of contaminant metals in the hydrocarbon feedstocks.

Vasalos, U.S. Pat. No. 4,153,535, also teaches the use of an oxidation catalyst to reduce carbon monoxide emissions. Suitable oxidiation catalysts, or "promoters," are ruthenium, rhodium, palladium, osmium, iridium, platinum, vanadium, tungsten, uranium, zirconium, rhenium, and silver. Zinc is not mentioned as an oxidation catalyst in the body of the specification. However, Example 24 of Vasalos shows that zinc has some utility as an oxidation catalyst when present at 0.3 weight percent, based on the total weight of the solid particles. In this example a synthetic flue gas made up of 4 volume percent carbon monoxide in a mixture of oxygen, steam, and nitrogen was passed over the catalyst and the content of carbon monoxide in the effluent gas was measured. Since this zinc-containing catalyst was never contacted with a metal-contaminated hydrocarbon feedstock, there could not have been any discovery that zinc is an effective passivating agent.

3. Zinc as a Sulfur Dioxide Absorbent

Vasalos, U.S. Pat. No. 4,153,534, discloses a catalytic cracking process which reduces the amount of sulfur dioxide leaving the catalyst regenerator. The process uses a conventional cracking catalyst and, in addition, a metallic reactant which reacts with the sulfur dioxide in the regenerator. Vasalos states that suitable metallic reactants are sodium, scandium, titanium, chromium, molybdenum, manganese, cobalt, nickel, antimony, copper, zinc, cadmium, lead, the fifteen rare earth metals, and compounds of these twenty-eight metals. The preferred metallic reactants are the oxides of sodium, manganese, and copper.

Vasalos teaches that the metallic reactants can generally be present in an amount from 50 parts per million to 10 weight percent, calculated as the metal and based on the total weight of the solid particles. When the metal is selected from the group consisting of zinc, cadmium, manganese, scandium, and cobalt, it is at an average level from 25 parts per million to about 7 weight percent. The more preferred amount is from 0.01 to 5 weight percent, and the most preferred amount is from 0.01 to 0.5 weight percent. The reactant can be deposited onto the catalyst, incorporated into the catalyst, or added to the regenerator separately from the catalyst.

In the Vasalos specification, examples 34, 35, and 37 deal with catalysts containing magnesium and zinc. The zinc concentrations were, respectively, 703, 1200, and 304 parts per million, based on the total weight of the solid particles. In these three examples, a synthetic flue gas made up of 1500 parts per million sulfur dioxide in a mixture of oxygen, steam, and nitrogen was passed over the catalyst and the content of sulfur dioxide in the effluent gas was monitored. And again, since this zinc-containing catalyst was never contacted with a metal-contaminated hydrocarbon feedstock, there could not have been any discovery that zinc is an effective passivating agent.

Other references which mention zinc as a sulfur dioxide absorbent include Vasalos, U.S. Pat. No. 4,153,535; Radford, U.S. Pat. No. 4,146,463; and Tatterson, U.S. patent application Ser. No. 91,470 (now U.S. Pat. No. 4,280,898).

SUMMARY OF THE INVENTION

The object of this invention is to provide an improved means of passivating contaminant metals which deposit on cracking catalysts. We have discovered that, when these contaminant metals are present in a hydrocarbon feedstock and become deposited on the catalyst, they can be passivated by contacting the cracking catalyst with a zinc-containing treating agent.

DETAILED DESCRIPTION OF THE INVENTION

1. Hydrocarbon Feedstock

This invention is a process for passivating contaminant metals which deposit on a cracking catalyst during the catalytic cracking of hydrocarbon feedstocks by the addition of a zinc-containing treating agent. The hydrocarbon feedstocks which are catalytically cracked generally have initial boiling points above 400° F. Such high-boiling feedstocks include gas oils, residual oils, shale oils, oils from coal, oils from tar sands, and mixtures thereof. A particularly useful feedstock comprises a mixture of gas oil and residual oil with either the gas oil or the residual oil present in a major amount.

As is well known, "gas oil" is a broad, general term covering a variety of feedstocks. The term includes light gas oil (boiling range 400° F. to 600° F.), heavy gas oil (boiling range 600° F. to 800° F.), and vacuum gas oil (boiling range 800° F. to 1100° F.). The term "residual oil" includes the portion of the crude oil which remains undistilled at about 1050° F. to 1200° F. under atmospheric pressure.

If the hydrocarbon feedstock being catalytically cracked is essentially free of the contaminant metals (nickel, copper, vanadium, and iron), passivation is of course, unnecessary. Nor is passivation required when the metals level in the feedstock is such that the catalyst withdrawal-replacement rate to maintain the desired catalyst activity is also sufficient to maintain the metals level on the catalyst at less than about 600 ppm Nickel Equivalent, where the adverse effects of the metals are tolerable. But as the metals level in the feedstock rises above this point, passivation becomes increasingly important. The minimum metals level at which passivation is used is dependent upon a number of factors, but will generally be at least about 1.0 ppm Nickel Equivalent. The more preferred feedstocks for the passivation process of this invention contain from about 5.0 to 40.0 ppm Nickel Equivalent.

2. Cracking Catalyst

The cracking catalysts suitable for use in the practice of this invention include all high-activity, fluidizable, solid catalysts which possess thermal stability under the required conditions. Suitable catalysts include those of the amorphous type containing silica, alumina, magnesia, or mixtures thereof. However, the preferred catalysts include those in which a crystalline zeolite is distributed throughout a porous matrix. The zeolite component is preferably present in an amount from 5 to 50 weight percent, based on the total weight of the solid particles. The zeolite-type cracking catalysts are preferred because of their thermal stability and their high catalytic activity.

The zeolite component of the zeolite-type cracking catalyst can be of any type or combination of types, natural or synthetic, which is known to be useful in catalyzing the cracking or hydrocarbons. Suitable zeolites include both naturally occurring and synthetic aluminosilicate materials such as faujasite, chabazite, mordenite, Zeolite X (U.S. Pat. No. 2,882,244), Zeolite Y (U.S. Pat. No. 3,130,007) and ultrastable large-pore zeolites (U.S. Pat. Nos. 3,293,192 and 3,449,070). These zeolites are usually prepared or occur naturally in the sodium form. The presence of this sodium can be undesirable, however, since the sodium zeolites have a low stability under hydrocarbon cracking conditions. Consequently, for use in this invention the sodium content of the zeolite is ordinarily reduced to the smallest possible value, generally less than about 1.0 weight percent and preferably below about 0.3 weight percent through ion exchange with hydrogen ions, hydrogen-precursors such as ammonium ion, or polyvalent metal cations including calcium, magnesium, strontium, barium and the rare earth metals such as cerium, lanthanum, neodymium and their mixtures. Suitable zeolites are able to maintain their pore structure under the high temperature conditions of catalyst manufacture, hydrocarbon processing and catalyst regeneration. These materials have a uniform pore structure of exceedingly small size, the cross-section diameter of the pores typically being in the range from about 4 to about 20 angstroms. Catalysts having a larger cross-section diameter can also be used.

The matrix of the zeolite-type cracking catalyst is a porous refractory material within which the zeolite component is dispersed. Suitable matrix and materials can be either synthetic or naturally occurring and include, but are not limited to, silica, alumina, magnesia, boria, bauxite, titania, natural and treated clays, kieselguhr, diatomaceous earth, kaoline and mullite. Mixtures of two or more of these materials are also suitable. Particularly suitable matrix materials comprise mixtures of silica and alumina, mixtures of silica with alumina and magnesia, and also mixtures of silica and alumina in combination with natural clays and clay-like materials. Mixtures of silica and alumina are preferred, however, and contain preferably from about 10 to about 80 weight percent of alumina mixed with from about 20 to about 90 weight percent of silica, and more preferably from about 25 to about 75 weight percent of alumina mixed with from about 25 to about 75 weight percent of silica.

3. Cracking Conditions

Catalytic cracking occurs when the hydrocarbon feedstock is contacted with the cracking catalyst at an elevated temperature. The contacting preferably occurs in an elongated riser reactor where the hydrocarbon-catalyst mixture is maintained at an elevated temperature in a fluidized or dispersed state for a period of time sufficient to effect the desired degree of conversion to lighter molecular weight hydrocarbons.

The specific conditions employed in the cracking, or reaction, zone depend on the feedstock used, the condition of the catalyst, and the products sought. In general, the cracking occurs at temperatures ranging from 850° F. to 1200° F. and at pressures ranging from atmospheric to 300 psig. Relatively high space velocities are usually employed. The weight ratio of catalyst-to-oil in the reactor can vary from 2 to 20 in order that the fluidized dispersion will have a density from 1 to 20 pounds per cubic foot.

The fluidizing velocity in the riser reactor can range from 10 to 100 feet per second. The riser reactor generally has a length of about 75 feet and a ratio of length-to-diameter of about 25. Under these conditions there is a very short period of contact in the reactor between the hydrocarbon and the catalyst, generally from 1 to 15 seconds.

Upon exiting the reactor, the hydrocarbon is separated from the catalyst and is recovered. The catalyst is, in turn, generally stripped with steam to remove entrained liquid or gaseous hydrocarbons. Then the catalyst is sent to a regenerating zone for removal of the coke which built up during the cracking process. In the regenerating zone an oxygen-containing gas, such as air, is added to burn off the coke at temperatures ranging from 1000° F. to 1500° F. The regenerated cracking catalyst is then reintroduced into the reactor.

4. Zinc Compounds Suitable as Treating Agents

In general, either elemental zinc or any zinc-containing compound can be used as a treating agent for passivation. The preferred zinc-containing treating agent in a given situation will vary depending upon cost and the manner in which the agent is added to the catalyst. For example, if zinc is added in an aqueous solution or dispersion, the preferred zinc compounds include zinc nitrate, zinc sulfate, zinc chloride, zinc acetate, zinc oxide, etc. The most preferred zinc compound for use with water is zinc nitrate because of its high solubility and low cost. As another example, if zinc is added in an organic solution or dispersion, the preferred zinc compounds include such oil-soluble compounds as zinc naphthanate and zinc acetonylacetonate.

5. Quantity of Zinc

In general, the zinc-containing treating agent is used in a quantity which is a function of the level of contaminant metals on the catalyst. And, as has been noted, the metals level on the catalyst is, in turn, a function of the metals level in the feedstock and of the rate of catalyst withdrawal-replacement. However, because of other constraints, the amount of zinc treating agent utilized is generally limited to the range of about 3.0 to 15.0, and preferably 5.0 to 10.0, weight percent, calculated as the metal and based on the total weight of the solid particles, i.e., the weight of the cracking catalyst plus the weight of the zinc treating agent.

The lower limit of 3.0 weight percent exists because of the effect of passivating agent saturation. It has been observed that, for a given quantity of passivating agent, as the metals level on the catalyst increases, a point is reached where the effect of the passivating agent becomes negligible. In other words, the production of coke for the passivated catalyst is virtually the same as for an untreated catalyst. When this point is reached, it is clear that there is no reason to add the passivating agent at all.

For example, when a zinc passivating agent is present at 3.0 weight percent, it is believed that the saturation effect occurs when the contaminant metals level on the catalyst rises to about 600 ppm Nickel Equivalent. This means that if the catalytic cracking unit is to be operated with a catalyst metals level of over about 600 ppm Nickel Equivalent, the presence of less than 3.0 weight percent zinc has virtually no effect. It will also be remembered that passivation is generally not used when the catalyst metals level is less than about 600 ppm Nickel Equivalent because the adverse effects are minimal. Therefore, it follows that, when the passivation process of this invention is practiced, the level of zinc will be at least about 3.0 weight percent.

The upper limit of 15.0 weight percent exists because of economics. As the zinc level rises above this limit, the loss in catalyst activity due to the presence of the zinc in the catalyst pores becomes prohibitive.

6. Method of Addition

The manner in which the zinc treating agent is applied to the catalyst does not appear to be critical and, accordingly, a variety of methods can be used. The zinc can be added as a finely dividied solid and dispersed on the catalyst by rolling, shaking, stirring, etc. The zinc can also be dissolved or dispersed in a suitable solvent, aqueous or organic, and the resulting solution used to impregnate the catalyst. Another method is to introduce the zinc into the cracking process cycle independently of the catalyst and incorporate it in situ into the cracking catalyst. For example, the zinc can be added with the feedstock in the reaction zone, with the oxygen-containing gas in the regeneration zone, or with the steam in the stripping zone. This form of zinc introduction can be done intermittently or continuously.

The following example is illustrative only.

EXAMPLE

This example illustrates that zinc nitrate is an effective passivating agent because the increase in coke-forming tendencies after exposure to contaminating metals was less for a zinc nitrate-treated catalyst than for a control catalyst.

The zinc-treated catalyst was a 15 percent rare-earth-type-Y (REY) zeolite in a matrix containing 10 percent zinc oxide (8 percent elemental zinc), 50 percent alumina, and 40 percent silica. It was prepared at room temperature, 70° F., as follows. The first step was to disperse, in a Waring blender, 441.5 g of REY zeolite in 700 ml of distilled water. The next step was to dissolve 850.9 g of $Zn(NO_3)_2.6H_2O$ in 1000 ml of distilled water. Following this, 19,499 g of silica alumina slurry was mixed with 8,934 g of alumina hydrosol. Then, into a large mixing bowl, were added the zeolite dispersion, the zinc nitrate solution, and the silica alumina-alumina hydrosol mixture. This slurry was mechanically stirred while 300 ml of concentrated ammonia and 3000 ml of distilled water were added. The slurry was then spray-dried.

The control catalyst was a 15 percent REY zeolite in a matrix containing 60 percent alumina and 40 percent silica. It was prepared by first blending together, at 70° F. in a large mixing bowl, the following components: 16,313 g of silica alumina, 10,010 g of alumina hydrosol, and 382.5 g of REY zeolite. The mixture was gelled while being mechanically stirred by adding 350 ml of concentrated ammonia. The resulting slurry was spray-dried.

The silica alumina used in making the above catalysts contained 6.4 weight percent solids. Other specifications were: 70 weight percent silica, 20.7 weight percent alumina, 380 ppm sodium, 380 ppm iron, 28 ppm sulfate, and a surface area of 516 $m^2/g$. The alumina hydrosol used above contained 9.7 weight percent solids. Its other specifications were: 133 ppm sodium, less than 0.01 weight percent sulfur, and a surface area of 301 $m^2/g$. The REY zeolite used above was 85 percent crystalline and had an average unit cell size of 24.65 angstroms. It contained 7.0 weight percent water and 0.135 weight percent sodium. The rare earth composition was as follows: 3.4 percent lanthanum, 7.1 percent cerium, 0.69 percent praseodymium, 2.1 percent neodymium, 0.18 percent samarium, 0.61 percent gadolinium. All catalyst analyses are on a dry basis.

After the zinc-treated and control catalysts were spray-dried, they were subjected to conditions designed to approximate conditions in a commercial catalytic cracking unit. The catalysts were first steamed in 100 percent steam for five hours at 1400° F. They were then impregnated with a hexane solution of nickel and vanadium naphthanates to give 0, 500, 1000, and 2000 ppm Nickel Equivalents. The catalysts were dried at 250° F. and then calcined at 1000° F. for three hours in air. The "coke factors" were then measured.

The term "coke factor" (also known "carbon factor") is defined as the relative coke produced tendency of a catalyst to a standard catalyst at the same gas oil volume percent conversion. Although the term is widely used in the industry, the choice of the standard catalyst and of the test conditions vary from company to company.

Here, the coke producing tendency of the standard catalyst was determined as follows. Samples of the standard catalyst (an equilibrium catalyst from a catalytic cracking unit in Neodesha, Kans.) weighing 3.0 g were contacted with 0.7 cc of a wide-boiling (430°-1000° F.) high-sulfur feedstock at 905° F. for varying periods of time. The product streams were analyzed by gas chromotography to determine the gas oil volume percent conversion. The corresponding catalyst samples were analyzed for the amount of coke deposited thereon. These data were plotted and, after a few minor corrections were made, a curve was drawn representing the relationship between the amount of coke formed and the present conversion.

The above procedure was repeated using the non-standard catalysts except that the time of reaction was limited to 50 seconds. The percent conversion and the amount of coke formed were then measured. The amount of coke formed at this observed conversion was divided by the amount of coke formed with the standard catalyst at the same conversion to yield the coke factor.

The results obtained here are shown in Table I.

TABLE I

| | Coke Factors | | | |
|---|---|---|---|---|
| | Nickel Equivalent (ppm) | | | |
| Catalyst | 0 | 500 | 1000 | 2000 |
| Control | 1.03 | 2.19 | 2.29 | 2.82 |
| Zinc-Treated | 1.17 | 1.74 | 2.05 | 2.72 |

From the data in Table I, the change in the coke factor was then computed by subtracting the coke factor at 0 ppm Nickel Equivalent from the coke factors at 500, 1000, and 2000 ppm Nickel Equivalent. This change is an indication of the catalyst's tolerance to poisoning by contaminant metals, or in other words, it is an indication of the effectiveness of the passivating agent. The results are shown in Table II.

TABLE II

| | Change in Coke Factors | | | |
|---|---|---|---|---|
| | Nickel Equivalent (ppm) | | | |
| Catalyst | 0 | 500 | 1000 | 2000 |
| Control | Reference | 1.16 | 1.26 | 1.79 |
| Zinc-Treated | Reference | 0.57 | 0.88 | 1.55 |

The data in Table II show that zinc nitrate is an effective passivating agent since the changes in coke factor were less for the zinc-treated catalyst than for the control.

We claim:

1. A passivation process which comprises contacting, under cracking conditions: (a) a hydrocarbon feedstock containing a level of contaminant metals at least about 1.0 ppm Nickel Equivalent; (b) a cracking catalyst; and (c) a zinc-containing treating agent present in an amount from about 3.0 to 15.0 weight percent, calculated as the metal and based on the total weight of the solid particles.

2. The process of claim 1 wherein the feedstock contains a level of contaminant metals from about 5.0 to 40.0 ppm Nickel Equivalent.

3. The process of claim 1 wherein the feedstock comprises a major amount of gas oil and a minor amount of residual oil.

4. The process of claim 1 wherein the feedstock comprises a major amount of residual oil and a minor amount of gas oil.

5. The process of claim 1 wherein the zinc-containing treating agent is present in an amount from about 5.0 to 10.0 weight percent, calculated as the metal and based on the total weight of the solid particles.

6. The process of claim 2 wherein the zinc-containing treating agent is present in an amount of about 8.0 weight percent, calculated as the metal and based on the total weight of the solid particles.

7. The process of claim 6 wherein the zinc-containing treating agent comprises zinc nitrate.

8. The process of claim 7 wherein the zinc-containing treating agent is introduced into the reaction zone independently of the cracking catalyst.

9. A passivation process which comprises contacting, under cracking conditions: (a) a hydrocarbon feedstock; (b) a cracking catalyst having a contaminant metals level of at least about 600 ppm Nickel Equivalent; and (c) a zinc-containing treating agent present in an amount from about 3.0 to 15.0 weight percent, calculated as the metal and based on the total weight of the solid particles.

* * * * *

UNITED STATES PATENT OFFICE

CERTIFICATE OF CORRECTION

Patent No. 4,363,720 Dated DECEMBER 14, 1982

Inventor(s) HIRSCHBERG, EUGENE H.; BERTOLACINI, RALPH J.; and MODICA, FRANK

It is certified that error appears in the above-identified patent and that said Letters Patent are hereby corrected as shown below:

Column 3, line 65, "oxidiation" should be --oxidation--.

Column 5, line 59, "cracking or" should be --cracking of--.

Column 8, line 2, "dividied" should be --divided--.

Column 9, line 6, "produced" should be --producing--.

Column 9, line 15, "Kans." should be --Kansas--.

Column 9, line 19, "chromotography" should be --chromatography--.

Column 10, line 17, "(b) a cracking catalyst;" should be --(b) a solid particulate cracking catalyst;--.

UNITED STATES PATENT OFFICE
CERTIFICATE OF CORRECTION

Patent No. 4,363,720 Dated DECEMBER 14, 1982

Inventor(s) HIRSCHBERG, EUGENE H.; BERTOLACINI, RALPH J.; and MODICA, FRANK

It is certified that error appears in the above-identified patent and that said Letters Patent are hereby corrected as shown below:

Column 10, lines 18-21, "a zinc-containing treating agent present in an amount from about 3.0 to 15.0 weight percent, calculated as the metal and based on the total weight of the solid particles." should be --a metal-containing treating agent present in an amount from about 3.0 to 15.0 weight percent, calculated as zinc metal and based on the total weight of said solid particulate cracking catalyst.--.

Signed and Sealed this

*Sixth* Day of *September 1983*

[SEAL]

*Attest:*

GERALD J. MOSSINGHOFF

*Attesting Officer* *Commissioner of Patents and Trademarks*